US010047507B2

(12) United States Patent
Wang et al.

(10) Patent No.: US 10,047,507 B2
(45) Date of Patent: Aug. 14, 2018

(54) COOL WATER DRAINING DEVICE OF A BATHTUB

(71) Applicant: XIAMEN SOLEX HIGH-TECH INDUSTRIES CO., LTD., Xiamen, Fujian (CN)

(72) Inventors: Qiang Wang, Fujian (CN); Lihong Hu, Fujian (CN); Jun Han, Fujian (CN); Chunyu Jiang, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 0 days.

(21) Appl. No.: 15/377,499

(22) Filed: Dec. 13, 2016

(65) Prior Publication Data

US 2017/0298598 A1 Oct. 19, 2017

(30) Foreign Application Priority Data

Apr. 15, 2016 (CN) ..... 2016 1 0234790

(51) Int. Cl.
*E03C 1/04* (2006.01)
*E03C 1/02* (2006.01)

(52) U.S. Cl.
CPC ..... *E03C 1/0408* (2013.01); *E03C 2001/026* (2013.01)

(58) Field of Classification Search
CPC ..... E03C 1/0408; E03C 1/041
USPC ..... 4/678
See application file for complete search history.

(56) References Cited

U.S. PATENT DOCUMENTS

2015/0096116 A1* 4/2015 Doss ..... E03C 1/0408 4/570

* cited by examiner

*Primary Examiner* — Tuan N Nguyen
(74) *Attorney, Agent, or Firm* — Rabin & Berdo, P.C.

(57) ABSTRACT

A cool water draining device of a bathtub includes a main body, a waterway switch valve, a flow regulating valve; the waterway switch valve and the flow regulating valve are disposed at the outlet passage of the main body; the flow regulating valve is disposed with a temperature control passage and a normal open passage; the waterway switch valve is disposed with an inlet and an outlet, the inlet keeps connected to the outlet passage; when the waterway switch valve is in the initial position, the outlet is connected to the temperature control passage; when the waterway switch valve is switched to a first gear, the outlet is connected to the normal open passage; when the waterway switch valve is switched to the second gear, the outlet is closed; the temperature control passage has a static element, a moving element and a thermal element.

10 Claims, 7 Drawing Sheets

COOL WATER DRAINING DEVICE OF A BATHTUB

FIELD OF THE INVENTION

The present invention relates to a sanitary ware, especially to a cool water draining device.

BACKGROUND OF THE INVENTION

In the water draining device of the existing bathtubs, cool water would leave in the pipe and the shower head end and the spraying shower end connected to the switch valve, therefore, when the user is getting a shower, cool water would be going to the human being that he may get ill, the water draining device is bad in comfort. If the user gets cool water draining first, he needs to stay beside the shower head to get shower after the cool water is drained out. This is a waste of time and labor, it is bad in user experience. If there is a cool water draining device that it opens to automatically drain cool water out and automatically closes after the cool water is drained out, the user doesn't need to stay beside the shower head when draining cool water out, the user can also operate the shower head to get the warm water, the user experience can be efficiently improved.

SUMMARY OF THE INVENTION

The present invention is provided with a cool water draining device of a bathtub that when the user uses, cool water in the pipe flows out of the cool water draining device, after the cool water drains out, the cool water draining device would automatically close, it can ensure that the user can get hot water, it also avoids over exhausting of the water and waste of hot water, it doesn't need user waiting beside, thus efficiently improves the user experience.

The technical proposal of the present invention is that:

A cool water draining device of a bathtub, wherein comprising a main body, a waterway switch valve, a flow regulating valve; the waterway switch valve and the flow regulating valve are disposed at the outlet passage of the main body;

the flow regulating valve is disposed with a temperature control passage and a normal open passage; the waterway switch valve is disposed with an inlet and an outlet, the inlet keeps connected to the outlet passage; when the waterway switch valve is in the initial position, the outlet is connected to the temperature control passage; when the waterway switch valve is switched to a first gear, the outlet is connected to the normal open passage; when the waterway switch valve is switched to the second gear, the outlet is closed;

the temperature control passage comprises a static element, a moving element and a thermal element; the moving element has a portion embedded to the static element, the thermal element is embedded to the moving element, the thermal port of the thermal element abuts against the moving element; the moving element is disposed with a sealing end and an outlet end, when the thermal port of the thermal element is in the initial length, the sealing end is separated from the static element, water flows to the static element from the outlet end and flows out of the temperature control passage; when the thermal port of the thermal element extends, the moving element moves along the axis of the static element to make the sealing end abuts against the static element in sealing way.

In another preferred embodiment, the moving element is further disposed with a decompression hole; when the sealing end abuts against the static element in sealing way, a small amount of water flows to the static element from the decompression hole and flows out of the temperature control passage.

In another preferred embodiment, the main body is disposed with a chamber to place the flow regulating valve in the length direction of the main body; the side surface of the main body is disposed with a hole connected to the chamber; the waterway switch valve is coupled to the flow regulating valve via the hole.

In another preferred embodiment, the cool water draining device further comprises a dial button, the dial button is linked to a valve rod of the waterway switch valve; when the dial button is dialed, the waterway switch valve is switched among the initial position, the first gear and a second gear.

In another preferred embodiment, the flow regulating valve comprises a valve body, the front end of the valve body is disposed with a first opening and a second opening; the side surface of the valve body is disposed with a third opening and a fourth opening respectively connected to the first opening and the second opening; the second opening and the fourth opening form the normal open passage.

In another preferred embodiment, the front end of the static element is connected to the third opening in sealing way; the first opening, the third opening, the static element, the moving element and the thermal element form the temperature control passage.

In another preferred embodiment, the external surface of the static element is sleeved with a reset spring, one end of the reset spring is fixedly connected to the front end of the static element, the other end is free.

In another preferred embodiment, the portion of the moving element exposed out of the static element is disposed with a boss; when the sealing end abuts against the static element in sealing way, the boss squeezes the free end of the reset spring.

In another preferred embodiment, the cool water draining device further comprises a shower head and a lift switch; when the waterway switch valve is switched to the second gear, water flows to the shower head from the main body.

In another preferred embodiment, the lift switch and the outlet of the shower head are vertically configured, when the lift switch is not yet lifted, a lift rod of the lift switch closes the outlet of the shower head; when the lift switch is lifted, the outlet of the shower head is open; the lift rod is disposed with a decompression through hole; when the lift switch is not yet lifted, a small amount of water flows out via the decompression through hole.

Compared to the existing known technology, the present invention has advantages as follows:

1. The present invention is provided with a cool water draining device of a bathtub that when the waterway switch valve is in the initial position, the waterway switch valve is connected to the temperature control passage of the flow regulating valve; after the user turns on the volume switch, cool water in the water pipe flows out of the temperature control passage but not the shower head, so as to achieve cool water draining function. In addition, when the cool water in the water pipe has drained out, the thermal element in the temperature control passage detects that the water temperature rises, the thermal port of the thermal element extends, making the moving element abut against the static element in sealing way so as to close the temperature control passage, avoiding wasting hot water.

2. The present invention is provided with a cool water draining device of a bathtub that to avoid overlarge water pressure in the cool water draining device causing by the temperature control passage being totally closed, the moving element is further disposed with a decompression hole, when the moving element abuts against the static element in sealing way, a small amount of water can still drain out via the decompression hole through the temperature control passage to avoid overlarge pressure.

3. The present invention is provided with a cool water draining device of a bathtub that when the cool water has drained out, the user can dial the dial button of the cool water draining device to select the first gear and the second gear. If the first gear is selected, the waterway switch valve is connected to the normal open passage, water flows directly to the bathtub through the normal open passage to achieve water storing in the bathtub function. If the second gear is selected, the outlet of the waterway switch valve is closed, water flows back to the shower head through the inlet of the waterway switch valve, if the user lifts the lift switch of the shower head, it can achieve draining of the shower head.

4. The present invention is provided with a cool water draining device of a bathtub that to avoid overlarge water pressure in the shower head after the user selects the shower head to drain water but not lifts the lift switch in time, the lift rod of the lift switch is disposed with a decompression through hole, if the lift switch—is not lifted, a small amount of water flows out of the shower head through the decompression through hole, thus avoiding high pressure.

5. The present invention is provided with a cool water draining device of a bathtub that the waterway switch valve is applied with a switch valve with automatic reset function, the waterway switch valve would automatically reset to the initial position after the user turns off the volume switch.

6. The present invention is provided with a cool water draining device of a bathtub that the temperature control passage is further disposed with a reset spring, when the moving element abuts against the static element in sealing way, the reset spring is compressed by the moving element. After the water temperature falls after rise, the thermal port of the thermal element retracts back, the moving element is reset by the elastic force of the reset spring.

DETAILED DESCRIPTION OF THE EMBODIMENTS

The present invention will be further described with the drawings and the embodiments.

Figure 1:
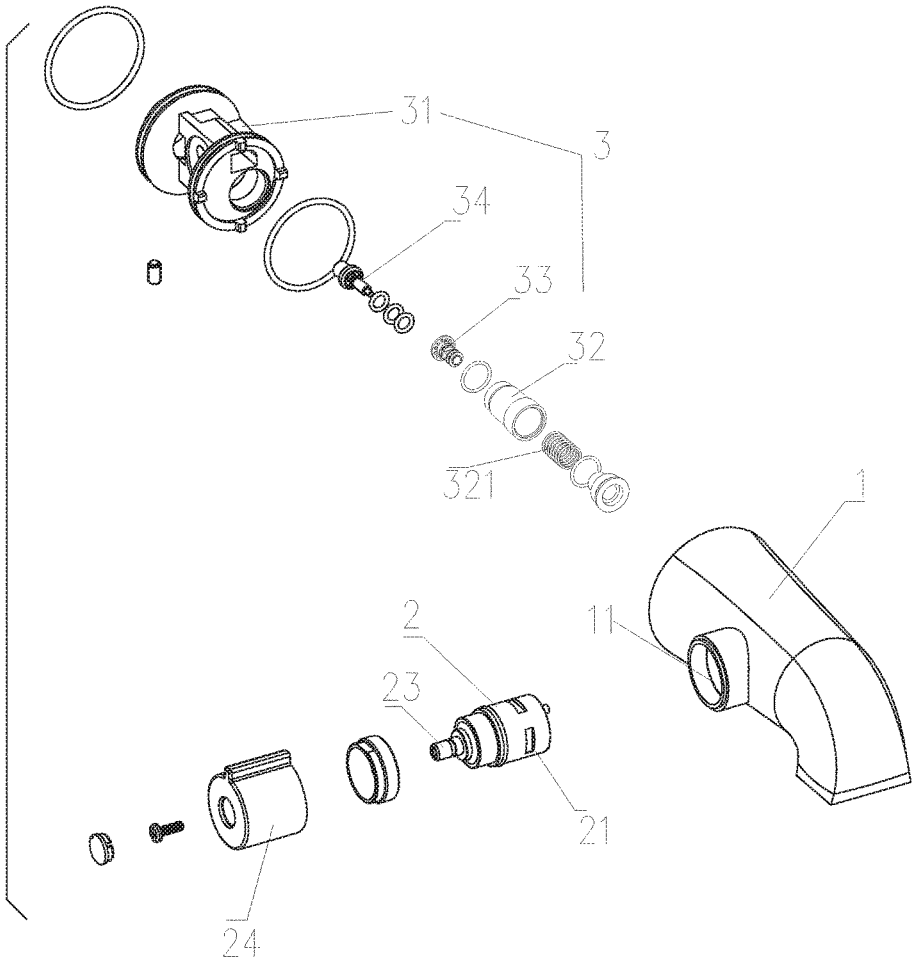
FIG. 1 illustrates an exploded and schematic diagram of a preferred embodiment of the present invention.
Figure 2:
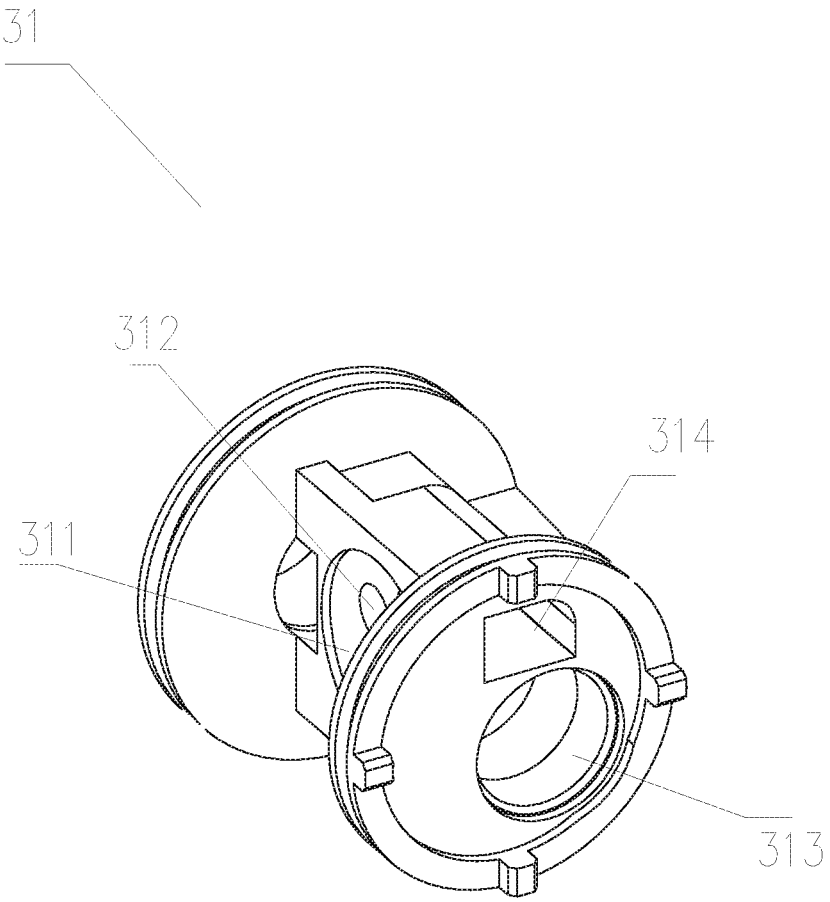
FIG. 2 illustrates a schematic diagram of the valve body of the flow regulating valve of the present invention.
Figure 3:
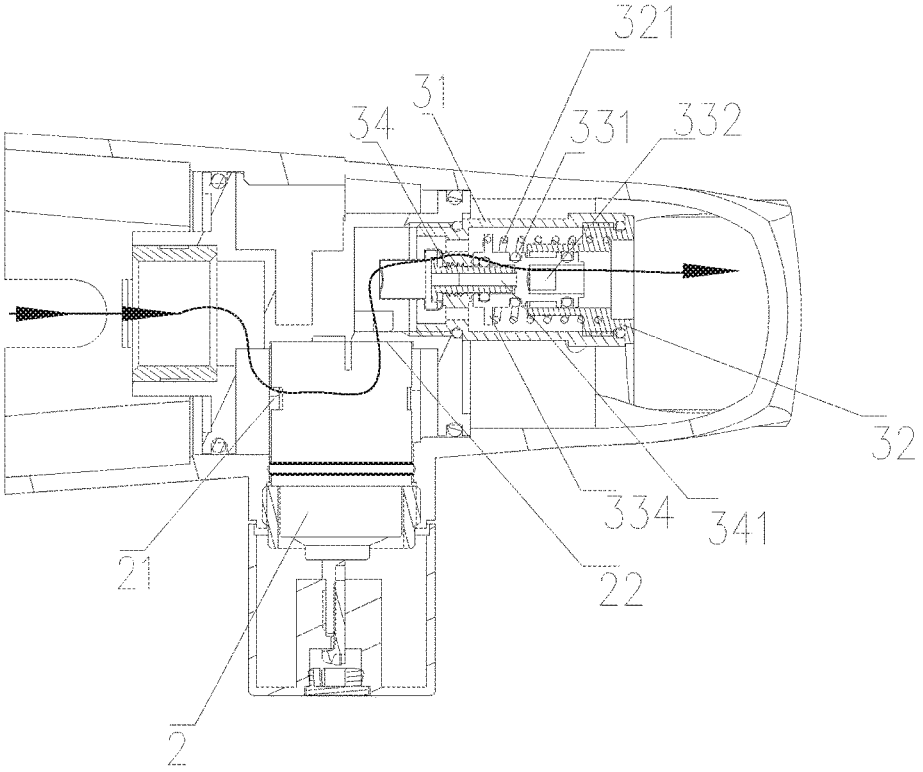
FIG. 3 illustrates a sectional diagram of the present invention with the waterway direction when the cool water is not yet drained out in draining state.
Figure 4:
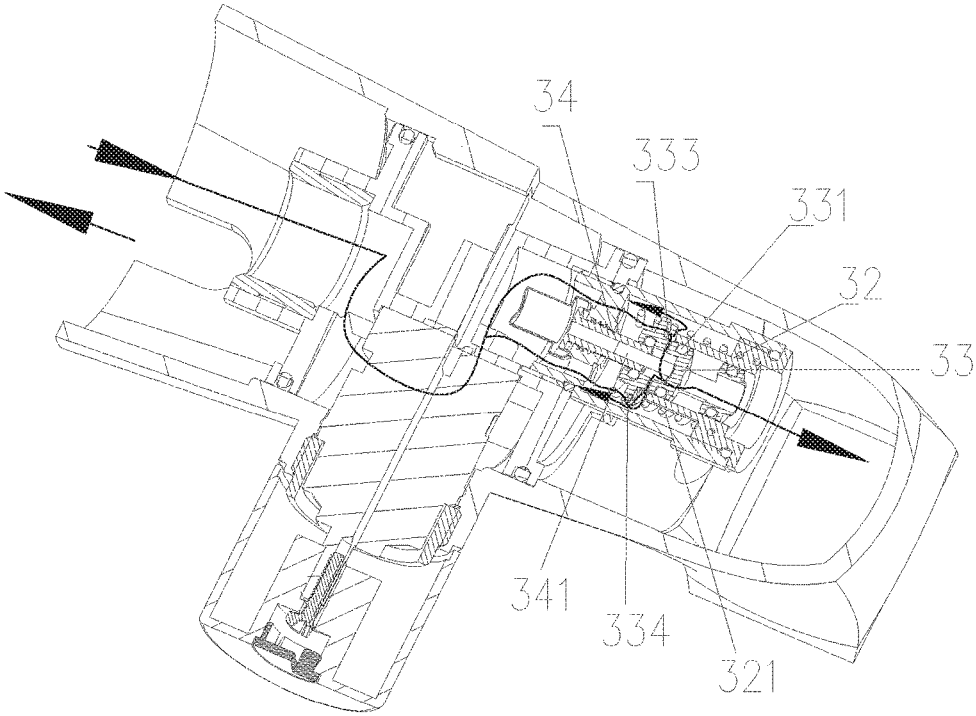
FIG. 4 illustrates a sectional diagram of the present invention with the waterway direction when the cool water is totally drained out in draining state.
Figure 5:
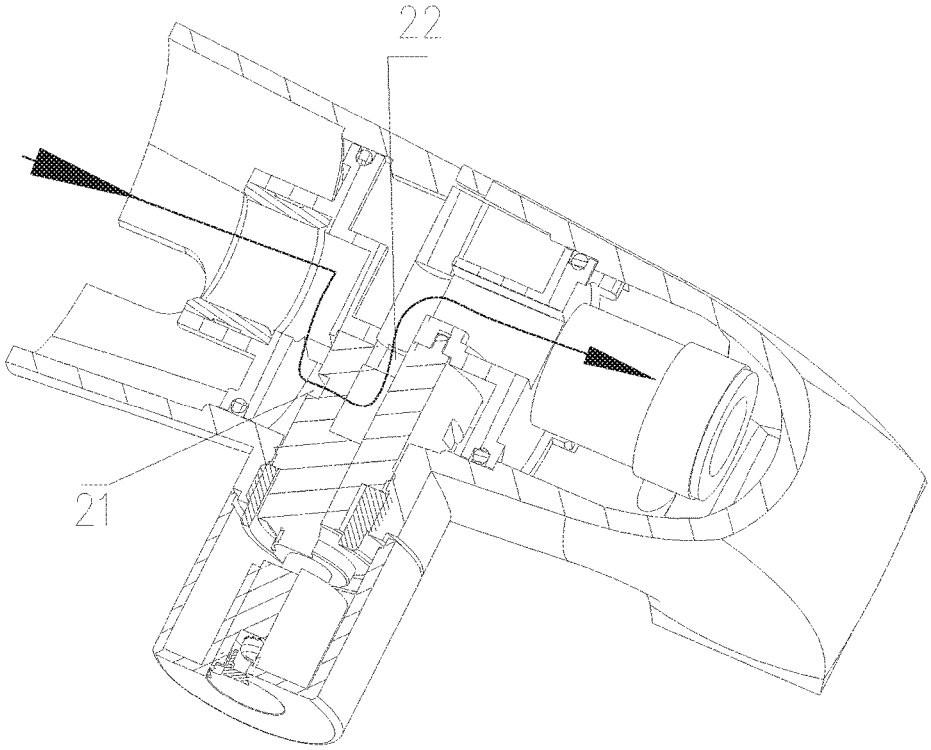
FIG. 5 illustrates a sectional diagram of the present invention with the waterway direction when the bathtub is in water storing state.
Figure 6:
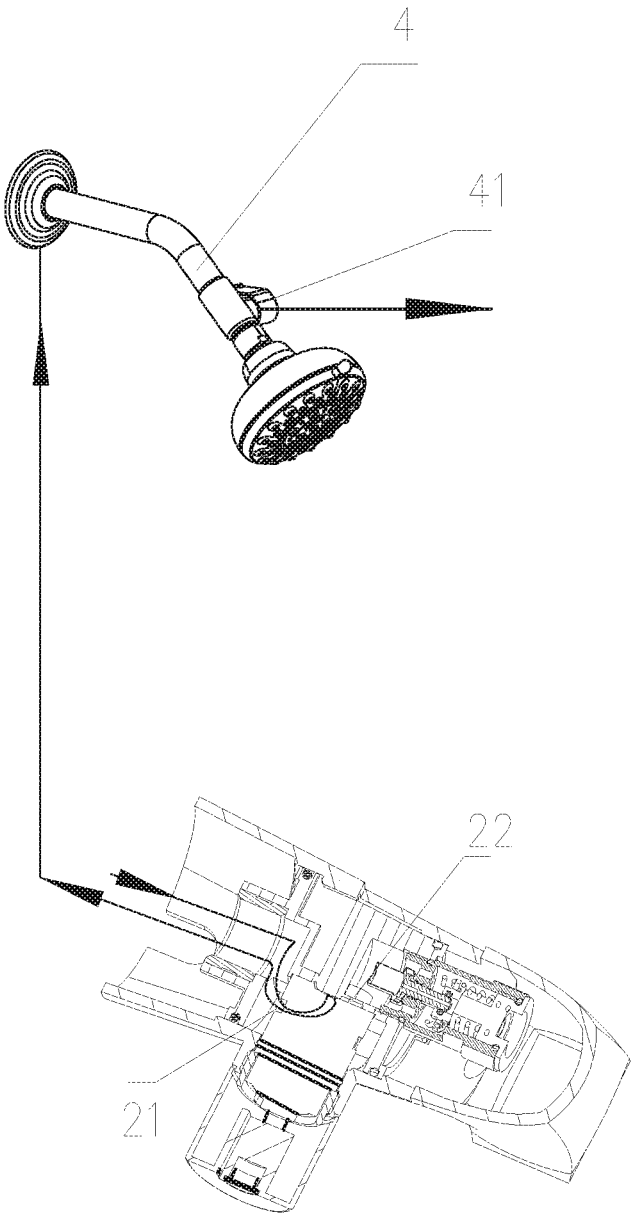
FIG. 6 illustrates a sectional diagram of the present invention with waterway direction when the shower head drains water out.
Figure 7:
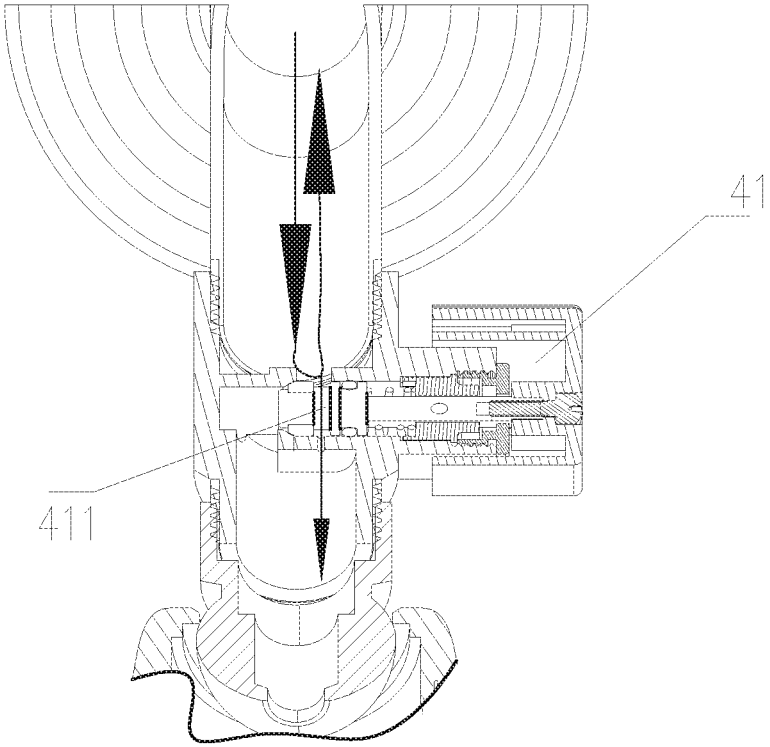
FIG. 7 illustrates a sectional diagram of the present invention with the waterway direction when the shower head decompresses.

Referring to FIGS. 1-7, a cool water draining device of a bathtub comprises a main body 1, a waterway switch valve 2, a flow regulating valve 3. A shower head 4 and a lift switch 41 are configured to the cool water draining device.

The main body 1 is disposed with a chamber to place the flow regulating valve 3 in the length direction of the main body; the side surface of the main body is disposed with a hole 11 connected to the chamber; the waterway switch valve 2 is coupled to the flow regulating valve 3 via the hole 11. The waterway switch valve 2 and the flow regulating valve 3 are disposed in the outlet passage of the main body 1.

The flow regulating valve 3 is disposed with a temperature control passage and a normal open passage; in detailed, the flow regulating valve 3 comprises a valve body 31, the front end of the valve body is disposed with a first opening 311 and a second opening 312; the side surface of the valve body is disposed with a third opening 313 and a fourth opening 314 respectively connected to the first opening 311 and the second opening 312; the second opening 312 and the fourth opening 314 form the normal open passage.

The temperature control passage comprises a static element 32, a moving element 33 and a thermal element 34; the moving element 33 has a portion embedded to the static element 32, the thermal element 34 is embedded to the moving element 33, the thermal port 341 of the thermal element 34 abuts against the moving element 33; the moving element is disposed with a sealing end 331 and an outlet end 332; the front end of the static element 32 is connected to the third opening 313 in sealing way; the first opening 311, the third opening 313, the static element 32, the moving element 33 and the thermal element 34 form the temperature control passage.

When the thermal port 341 of the thermal element is in the initial length, the sealing end 331 is separated from the static element 32, the temperature control passage is open; when the thermal port 341 of the thermal element extends, the sealing end 331 abuts against the static element 32 in sealing way, so that the temperature control passage is closed.

The waterway switch valve 2 is disposed with an inlet 21 and an outlet 22, the inlet 21 is disposed at the side surface of the waterway switch valve 2, the outlet 22 is disposed at the bottom surface of the waterway switch valve 2. The inlet 21 keeps connected to the outlet passage; when the waterway switch valve 2 is in the initial position, the outlet 22 is connected to the temperature control passage; a valve rod 23 of the waterway switch valve 2 is linked to a dial button 24; when the dial button 24 is dialed, the waterway switch valve 2 is switched among the initial position, a first gear and a second gear.

When the waterway switch valve 2 is switched to the first gear, the outlet 22 is connected to the normal open passage; when the waterway switch valve 2 is switched to the second gear, the outlet 22 is closed. Water flows back to the shower head 4 from the inlet 21 of the waterway switch valve 2. The lift switch 41 and the outlet of the shower head 4 are vertically configured, when the lift switch 41 is not yet lifted, the lift rod of the lift switch closes the outlet of the shower head 4; when the lift switch 41 is lifted, the outlet of the shower head 4 is open.

The cool water draining device is used as followed:

After the user turns on the volume switch, the waterway switch valve 2 is in the initial position, the outlet 22 is connected to the temperature control passage, water flows to the bathtub from the outlet of the cool water draining device through the temperature control passage, so as to achieve cool water draining function. In addition, when the cool water in the water pipe has drained out, the thermal element 34 in the temperature control passage detects that the water temperature rises, the thermal port 341 of the thermal element 34 extends, making the moving element 33 abut against the static element 32 in sealing way so as to close the temperature control passage, avoiding wasting hot water. It thus achieves two functions of cool water automatically draining and automatically turning off after cool water draining out.

When the cool water has drained out, the user can select to get a shower with the shower head in hot water and to store water in the bathtub with the cool water draining device. When the users wants to fill water to the bathtub, he can dial the dial button 24 to the first gear, the outlet 22 of the waterway switch valve is connected to the normal open passage, water flows directly to the bathtub through the normal open passage to achieve bathtub water storing function.

When the users dial the dial button 24 to the second gear, the outlet 22 of the waterway switch valve 22 is closed, water flows back to the shower head 4 through the inlet 21 of the waterway switch valve 2, the user can lift the lift switch 41 of the shower head to achieve water draining function of the shower head 4.

This embodiment can be also configured as follows:

To avoid a large amount of hot water gathers in the main body 1 and causes overlarge water pressure to damage the main body after the cool water has drained out and the user doesn't select to store water in the bathtub and to get the shower head to drain out water in time, the moving element 33 is further disposed with a decompression hole 333; when the sealing end 331 abuts against the static element 32 in sealing way, a small amount of water flows to the static element 32 through the decompression hole and flows out of the temperature control passage.

To avoid overlarge water pressure in the shower head after the user selects the shower head to drain water but not lifts the lift switch 41 in time, the lift rod of the lift switch 41 is disposed with a decompression through hole 411, if the lift switch 41 is not lifted, a small amount of water flows out of the shower head through the decompression through hole 411, thus avoiding high pressure.

To make the temperature control passage can automatically open after the temperature of mixing water in the main body 1 is decreased, the external surface of the static element 32 is sleeved with a reset spring 321, one end of the spring is fixedly connected to the front end of the static element 32, the other end is a free end. The portion of the moving element 32 exposed out of the static element 32 is disposed with a boss 334; when the sealing end 331 abuts against the static element 32 in sealing way, the boss 334 squeezes the free end of the reset spring 321. Therefore, after the water temperature in the main body falls after rise, the thermal port of the thermal element retracts back, the moving element 33 is reset by the elastic force of the reset spring 321.

Besides, the waterway switch valve 2 is applied with a switch valve with automatic reset function, the waterway switch valve 2 would automatically reset to the initial position after the user turns off the volume switch.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A cool water draining device of a bathtub, comprising:

a main body, a waterway switch valve, and a flow regulating valve;

the waterway switch valve and the flow regulating valve being disposed at an outlet passage of the main body;

wherein:

the flow regulating valve is disposed with a temperature control passage and a normal open passage;

the waterway switch valve is disposed with an inlet and an outlet, the inlet being connected to the outlet passage;

when the waterway switch valve is in an initial position, the outlet is connected to the temperature control passage;

when the waterway switch valve is switched to a first gear, the outlet is connected to the normal open passage;

when the waterway switch valve is switched to a second gear, the outlet is closed;

the temperature control passage comprises a static element, a moving element and a thermal element;

the moving element has a portion embedded in the static element, the thermal element is embedded in the moving element, and a thermal port of the thermal element abuts against the moving element;

the moving element is disposed with a sealing end and an outlet end, and when the thermal port of the thermal element is in an initial length, the sealing end is separated from the static element, water flows to the static element from an outlet end and flows out of the temperature control passage; and when the thermal port of the thermal element extends, the moving element moves along an axis of the static element to make the sealing end abut against the static element to form a seal.

2. The cool water draining device of a bathtub according to claim 1, wherein:

the moving element is further disposed with a decompression hole; and when the sealing end abuts against the static element to form the seal, an amount of water flows to the static element from the decompression hole and flows out of the temperature control passage.

3. The cool water draining device of a bathtub according to claim 2, wherein:

the main body is disposed with a chamber to place the flow regulating valve in a length direction of the main body;

a side surface of the main body is disposed with a hole connected to the chamber; and the waterway switch valve is coupled to the flow regulating valve via the hole.

4. The cool water draining device of a bathtub according to claim 3, wherein:

the cool water draining device further comprises a dial button, and the dial button is linked to a valve rod of the waterway switch valve; and when the dial button is dialed, the waterway switch valve is switched among the initial position, the first gear and the second gear.

5. The cool water draining device of a bathtub according to claim 4, wherein:

the flow regulating valve comprises a valve body, and a front end of the valve body is disposed with a first opening and a second opening;

a side surface of the valve body is disposed with a third opening and a fourth opening respectively connected to the first opening and the second opening; and the second opening and the fourth opening form the normal open passage.

6. The cool water draining device of a bathtub according to claim 5, wherein:

a front end of the static element is connected to the third opening to form a seal; and the first opening, the third opening, the static element, the moving element and the thermal element form the temperature control passage.

7. The cool water draining device of a bathtub according to claim 6, wherein an external surface of the static element is sleeved with a reset spring, one end of the reset spring is fixedly connected to the front end of the static element, and another end of the reset spring is free.

8. The cool water draining device of a bathtub according to claim 7, wherein:

a portion of the moving element exposed out of the static element is disposed with a boss; and when the sealing end abuts against the static element to form the seal, the boss squeezes the free end of the reset spring.

9. The cool water draining device of a bathtub according to claim 8, wherein:

the cool water draining device further comprises a shower head and a lift switch; and when the waterway switch valve is switched to the second gear, water flows to the shower head from the main body.

10. The cool water draining device of a bathtub according to claim 9, wherein:

the lift switch and the outlet of the shower head are vertically configured, and when the lift switch is not yet lifted, a lift rod of the lift switch closes an outlet of the shower head;

when the lift switch is lifted, an outlet of the shower head is open;

the lift rod is disposed with a decompression through hole; and when the lift switch is not yet lifted, an amount of water flows out via the decompression through hole.

* * * * *